United States Patent [19]

Glowacki

[11] 4,384,942

[45] May 24, 1983

[54] CANNULAE GRINDING METHOD AND MACHINE

[75] Inventor: John J. Glowacki, Orange, Conn.

[73] Assignee: Lifeline Products, Inc., Wallingford, Conn.

[21] Appl. No.: 185,303

[22] Filed: Sep. 8, 1980

[51] Int. Cl.[3] ..... B23P 1/10; B23P 1/12; B24B 7/00; B24B 19/00

[52] U.S. Cl. ..... 204/129.46; 204/129.55; 204/202; 204/217; 204/224 M; 204/297 R; 51/76 R; 51/227H; 51/290; 51/320

[58] Field of Search ..... 51/76 R, 76 BS, 227 H, 51/290, 320, DIG. 9; 204/129.46, 129.55, 224 M, 202–205, 215, 217, 297 R, 297 W, 198

[56] References Cited

U.S. PATENT DOCUMENTS

| | | | |
|---|---|---|---|
| 2,546,914 | 3/1951 | Wheeler | 51/76 R |
| 3,164,933 | 1/1965 | Labowsky | 51/209 R |
| 3,539,314 | 11/1970 | Rockefeller et al. | 51/76 R |
| 3,594,296 | 7/1971 | Derwall | 204/129.46 X |
| 3,762,243 | 10/1973 | Borrkfield | 204/129.46 X |
| 3,835,587 | 9/1974 | Hall, Jr. | 51/290 |
| 3,991,522 | 11/1976 | Hedlund et al. | 51/76 BS X |
| 4,094,104 | 6/1978 | Zerfahs et al. | 51/76 R |
| 4,173,100 | 11/1979 | MacBroom, Jr. | 51/227 H |

*Primary Examiner*—Donald R. Valentine
*Attorney, Agent, or Firm*—Robert H. Montgomery

[57] ABSTRACT

A method and system for continuously grinding tubing to finished cannulae, where the tubing is loaded in a carrier and the carrier is continuously guided past stations which cut the primary bevel, finish the butt end, clean the cut ends, and then make lancelet cuts on the primary bevel. The system further includes a cannula carrier and guide system which permits the cannulae to be unclamped, rotated and reclamped prior to each lancelet cutting station.

26 Claims, 15 Drawing Figures

CANNULAE GRINDING METHOD AND MACHINE

This invention relates to a new and improved method and apparatus for grinding complete cannulae in one operation.

In the preparation of cannulae for hypodermic needles, a present method is to sheer the raw tubing to length on a tubing straightener or by separate units, then the tubes are taped into five inch long strips by an automatic taping unit; thereafter, the butt ends of the cannulae are cut and finished by buffing to remove oxidation that may be produced by electrolytic grinding or otherwise treated to remove burrs that may be produced by regular grinding. The primary bevel is then cut and deburred and then the lancet cuts made. An example of a portion of such technique is shown in U.S. Pat. No. 3,975,864. Another technique of grinding cannulae is by plunge grinding where the cannulae are held in a cartridge and a long grinding wheel plunges on to the cannulae to cut the primary bevel; thereafter the grinding wheel is slightly retracted and the cannulae rotated to a position for the lancet cuts and the grinding wheel brought back in. Such a method is disclosed in U.S. Pat. No. 4,104,833.

In both of the aforementioned patents, the butt ends of the cannulae must be cut and finished prior to being placed in the primary grinding cartridge or holder. Additionally, the grinding wheel must always be moved with respect to the cannulae.

The present invention provides a new system and method for increasing the speed in which cannulae may be finished, and a method and apparatus where the cannulae may be moved in a continuous path past various work stations to finish the cannulae in one operation.

Briefly stated, in the present invention, apparatus and methods are provided whereby after cutting the tubing to length and placing it in a cannular holder or cartridge, the cartridge is placed on a conveyor which passes the cannulae by two groups of grinding wheels; where the wheels of each group are stepped in diameter to quickly remove the stock in steps for both the primary bevel cut and the butt end cut. Preferably, the cuts are made by stepped electrolytic grinding wheels. Such electrolytic cutting produces oxidation on the cut ends. Thereafter, the cartridge is passed through a station for cleaning the oxidation off the bevel and the butt end. The cut ends are bombarded with small glass beads or pellets or other media to remove oxidation from the surfaces. The cartridges carrying the cannulae then pass through a third stage comprising two abrasive grinding wheels which will grind the lancet cuts on either side of the primary bevel cuts. Means are provided for rotating the cannulae in the cartridges prior to passing the abrasive wheels, thus completing the cannulae in one operation and one machine. The invention further provides new and improved means for carrying the cannulae to the work stations, and presenting the cannulae to the grinding wheels.

An object of this invention is to provide a new and improved method and apparatus for preparing cannulae in one operation.

The features of the invention which are believed to be novel are particularly pointed out and distinctly claimed in the concluding portion of the specification. The invention, however, both as to operation and organization, together with further objects and advantages thereof, may best be appreciated by reference to the following detailed description taken in conjunction with the drawings wherein:

To facilitate an understanding of the invention, a brief synopsis of the method will first be made.

Tubing cut to predetermined lengths are placed in a cannulae carrier. The tubes may be conventionally taped in lengths or the carrier may be parallel grooved or serrated to receive individual cannula. The carrier is then guided past a first grinding station where, as disclosed herein, the butt end is cut in successive steps to a predetermined length. A plurality of grinding wheels successively take off increments to increase the rate of production. Then, the carrier is guided past a second station, comprising a plurality of grinding wheels of increasing diameter where the primary bevel is cut in increments to finished dimension. Thereafter the carrier is moved past a third station where oxidation is removed from the cut ends as by means of bombarding with small glass beads or pellets or other media. The cannulae are then rotated slightly and guided past another grinding wheel where a first lancet cut is made on one side of the primary bevel. Then the cannulae are rotated in the carrier in the other direction and guided past before another grinding wheel where a lancet cut is made on the other side of the primary bevel.

The carriers are moved on a conveyor belt on guide means, and camming means are provided for appropriately tightly clamping the cannulae for a grinding cut and releasing the clamp to rotate the cannula for the lancet cuts and thereafter tightly reclamping the cannulae.

Figure 6:
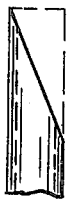
FIGS. 6–10 are views of a cannula at various stages of operation thereon.
Figure 7:
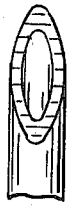
Figure 8:
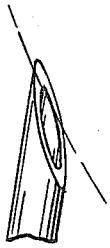
Figure 9:
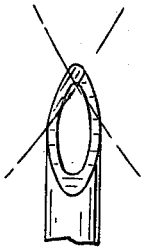
Figure 10:
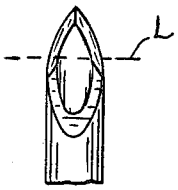

FIGS. 6 and 7 exemplify, the primary bevel. FIGS. 8 and 9 exemplify the lines of the lancet cuts, and FIG. 10 illustrates a finished cannula point.

Figure 1:
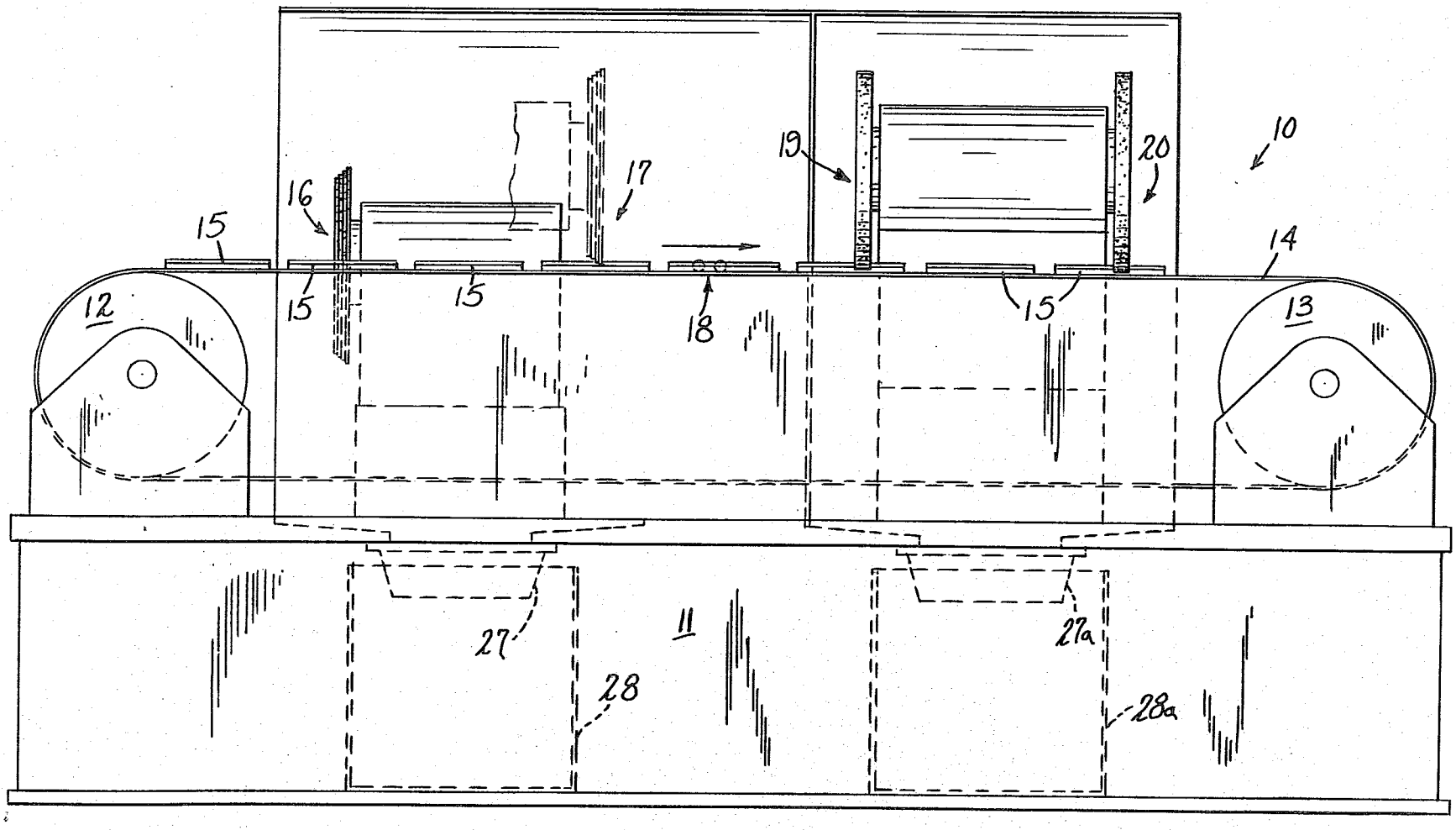
FIG. 1 is a side elevation of a system upon which the invention may be practiced; and, FIG. 2 is an end elevation of the system of FIG. 1 seen from the left side of FIG. 1.

As shown in FIG. 1, a system 10 in which the invention may be practiced comprises a base support member 11 having rotatedly mounted thereon a drive wheel 12 and an idler wheel 13 about which a conveyor 14, preferably of flexible steel, travels. Carried on conveyor 14 are a plurality of cannulae carriers or cartridges 15 which carry the cannulae past a plurality of work stations. The cannulae in the cartridges 15 are first moved past a grinding station generally indicated as 16 shown as comprising four stepped electrolytic grinding wheels of increasing diameter 16*a*–16*d* (FIG. 11), which will grind the butt end of the cannulae. Thereafter, cartridges move to a second work station 17 shown as comprising four stepped electrolytic grinding wheels of increasing diameter 17*a*–17*d* (FIG. 11) which place the primary bevel on the cannulae. The stepped wheels, each taking an increment of material from the tubes, permit a quicker full cut. The grinding wheels may be of the abrasive type, however, electrolytic grinding is preferred for the economy realized from reduced wheel wear.

The electrolytic grinding will leave oxidation on the ground surfaces. Such oxidation is removed at a work station 18, by bombarding the surfaces with small glass beads or pellets as hereinafter more fully described. Where abrasive grinding wheels are used, the beads will act to deburr the cut ends. Alternatively, deburring may be accomplished by a jet of liquid with material such as aluminum oxide. Thereafter, the cartridges will pass a work station 19 which is an abrasive grinding wheel where the cannulae are slightly rotated in a first direction to place a lancet cut on one side of the primary bevel as exemplified in FIG. 8; then at a next work station 20, the cannulae are rotated in the opposite direction to place the other lancet cut on the primary bevel as exemplified in FIG. 9.

Figure 2:
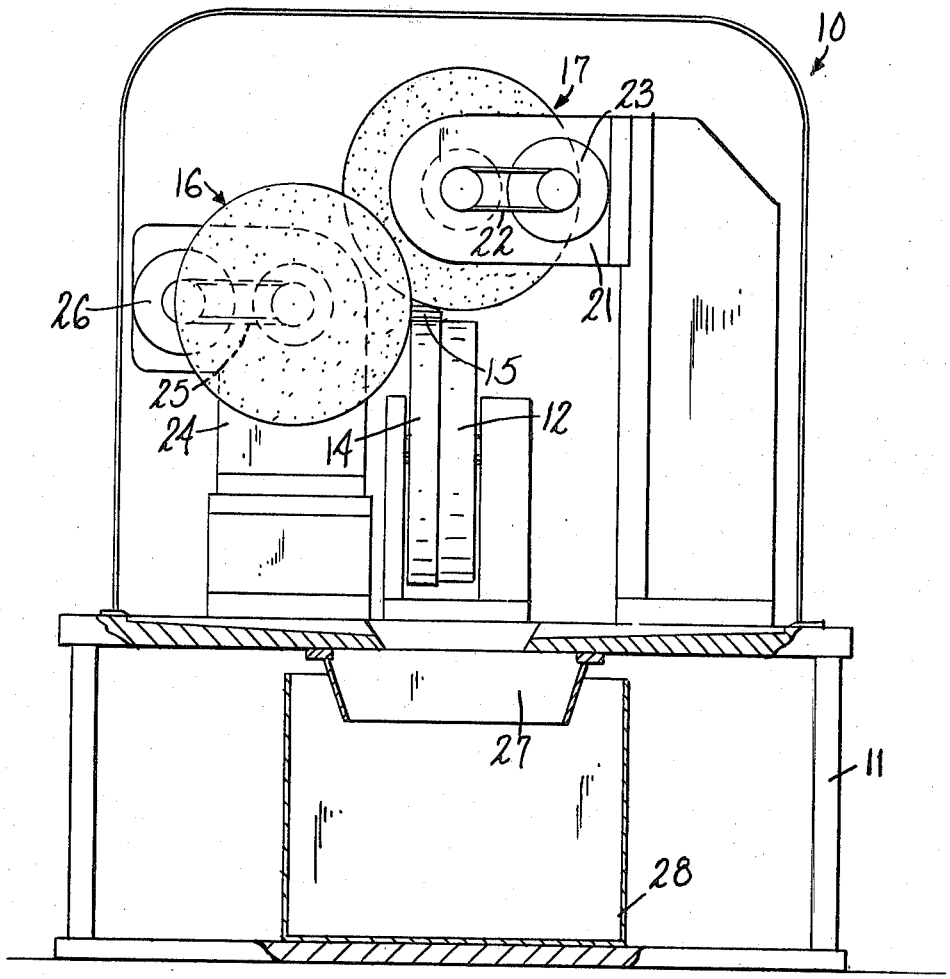

FIG. 2 shows an end view seen from the left end of FIG. 1. The wheels of station 17 are rotatedly mounted from an upstanding support 21 and driven through a pulley or belt 22 by a motor 23. The grinding wheels of station 16 are also rotatedly mounted on a support 24 and driven by a pulley 25 from a motor 26. The electrolytic fluid and grinding debris are carried through a hopper 27 into a sump 28 where the debris may be separated from the fluid and the fluid recirculated in a conventional manner. The same is true of stations 19 and 20 where cooling fluid and debris fall through a hopper 27*a* into a sump 28*a*.

The cannulae must be very tightly clamped during all grinding steps, and also the cleaning step. However, in order to rotate the cannulae for the lancet cuts, the clamping means must be at least partially released. The invention provides a cannulae carrier which tightly clamps the tubing, but releases to permit the cannula to be rotated for the lancet cuts, then tightly reclamped for the lancet cut.

Figure 3:
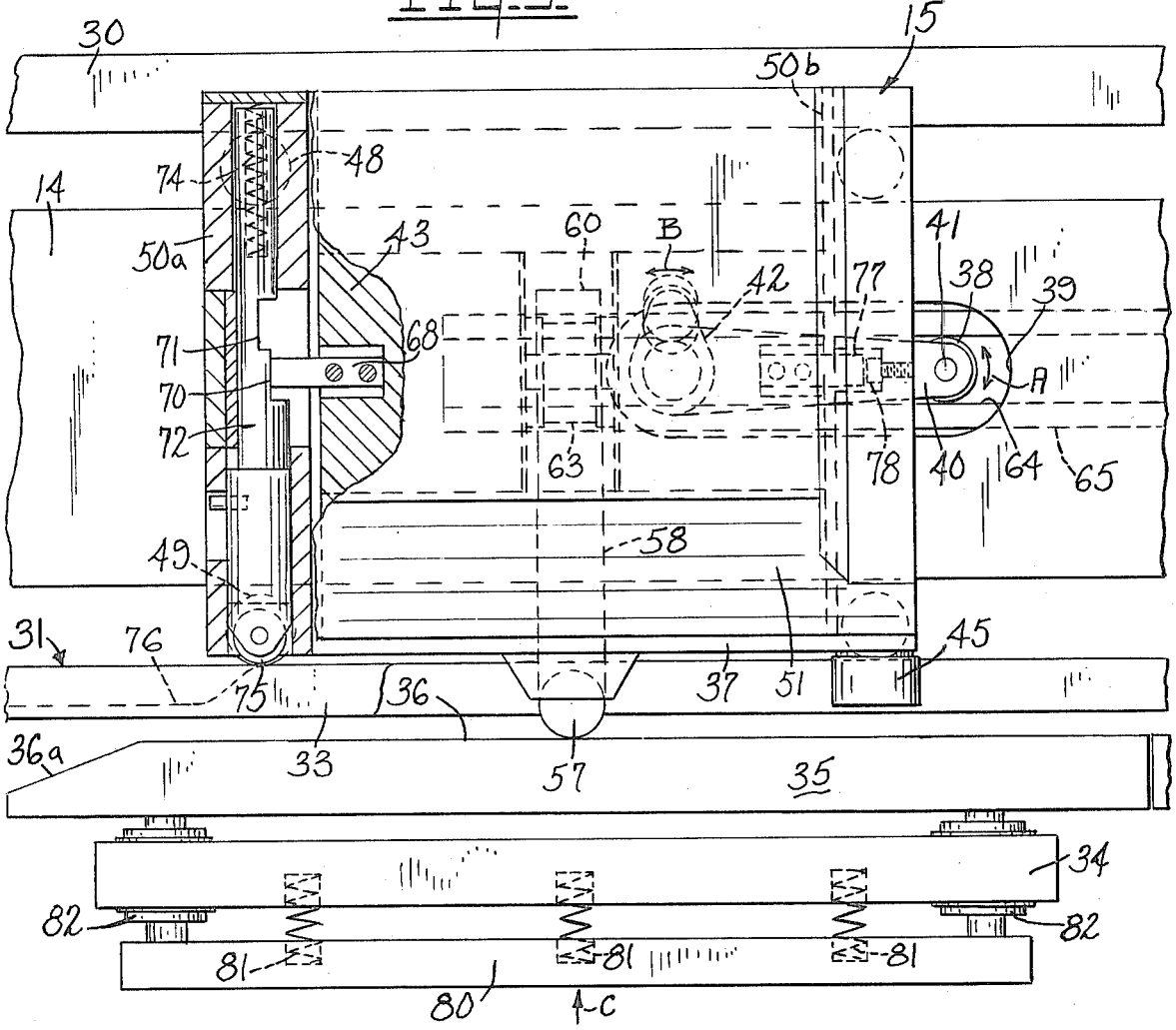
FIG. 3 is a plan view, partially cut away, of a cannula carrier utilized in the invention, and also showing parts of the apparatus of FIGS. 1 and 2.
Figure 4:
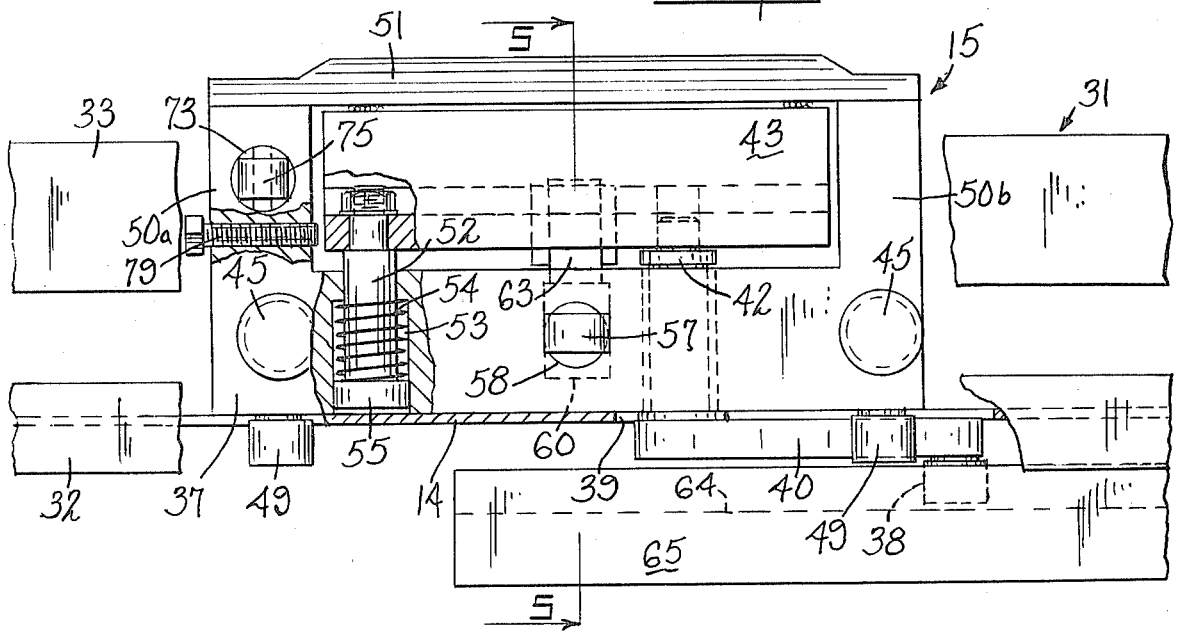
FIG. 4 is a side elevation, partially cut away, of the cannula carrier of FIG. 3.
Figure 5:
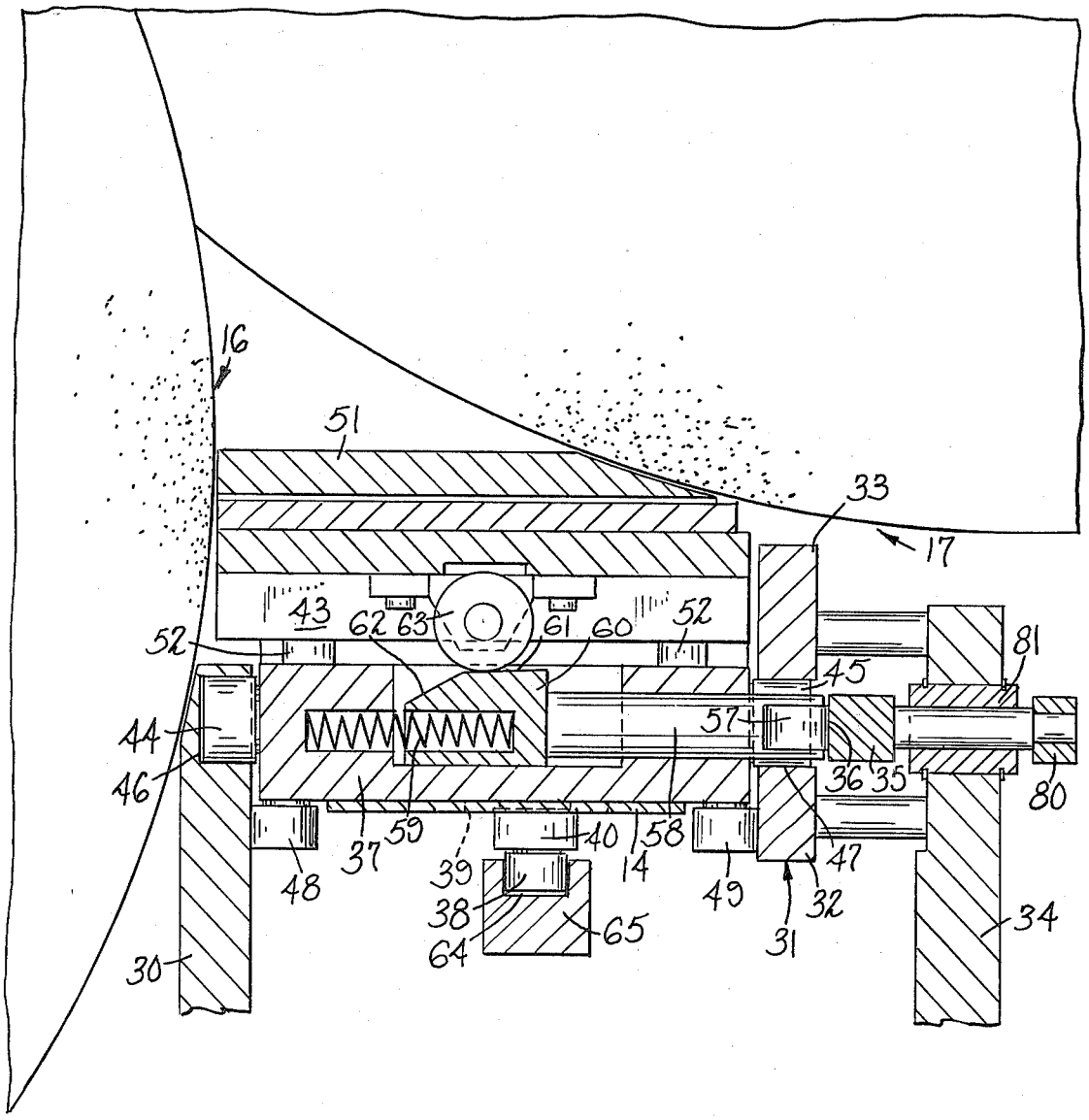
FIG. 5 is a sectional view seen in the plane of lines 5—5 of FIG. 4, and further showing the cannulae carrier in relation to grinding stations.

Reference is now made to FIGS. 3, 4 and 5 which show the cannulae carriers or cartridges 15 in greater detail.

Disposed on either side of conveyor belt 14 are guide members 30 and 31. Guide member 31 actually comprises upper and lower sections 32 and 33. The separate sections are supported from a member 34 which also supports means 35 defining a cam track surface 36. Each cannulae carrier 15 comprises a base member 37 which rides on conveyor 14 and has a follower 38 extending through an opening 39 in conveyor 14. Follower 38 is carried on an arm 40 on the end of a pivotal rod 41 in base member 37. Another arm 42 (FIG. 3) on the other end of rod is attached to a cannulae clamping member 43.

Extending from either side of base member 37 are followers 44 and 45. Follower 44 is guided in a track 46 defined in member 30 while follower 45 rides in a track 47 defined between members 32 and 33. This arrangement provides vertical positioning of carriers 15. Extending from the bottom on either side of base member 37 are pairs of followers 48 and 49 which roll on guide members 30 and 32 respectively. This arrangement provides lateral positioning of the carriers 15.

Base member 37, as seen from the side, (FIG. 4) is in the form of a bridge with upstanding ends 50*a* and 50*b* and a top crossmember 51 extending therebetween. Crossmember 51 cooperates as a clamp with member 43. Cannulae to be ground are carried between crossmember 51 and clamp member 43.

Clamp member 43 has extending therefrom a plurality of studs 52 into bores 53 in base member 37. Springs 54 disposed in bore 53 about the studs 52 and acting on the head 55 of the studs normally bias clamping member 43 downwardly.

Clamping member 43 is actuated by a follower member on cam track surface 36 including a follower roller 57, carried on a rod 58 biased by a spring 59 (FIG. 5). The spring 59 acts to maintain follower roller 57 in contact with the cam track 36. The follower includes a cam member 60 having camming surfaces 61 and 62 arranged to act on a roller 63 carried on the bottom of clamping member 43.

With this arrangement, clamping member 43 may be actuated as the carrier approaches grinding station 16 and clamping pressure may be released slightly in accordance with the cam track just before stations 19 and 20 to permit the cannulae to be rotated for the lancet cuts.

Follower 38 on carrier 15 extends into a cam track 64 in member 65. At stations 19 and 20 the cam track 64 may be shaped to produce pivotal motion of follower 38 as shown by the arrow A in FIG. 3. Alternatively, member 65 defining cam track 64 may be arranged to be hydraulically or pneumatically shifted laterally to produce motion of arms 40 and 42. This will then produce motion of clamping member 43 as shown by arrow B in FIG. 3. This slight motion of clamping member 43 with respect to cross member 51 will rotate the cannula a predetermined amount to be positioned for the lancet cuts.

Secured to clamping member 43 and extending therefrom is a finger 68 which is adapted to cooperate with stopping flats 70 and 71 on a cannulae positioning and motion limiting member 72. Member 72 is a rodlike member biased outwardly of base 37 by a spring 74. Member 72 further includes a follower roller 75 which will act on a cam track 76 defined on member 31. Member 72 is positioned in the mid-position as shown in FIG. 3. If the positioning rod moves outwardly, finger 68 will extend toward flat 71 and flat 71 acts as the absolute limit of motion of clamping member 43. Also carried on clamping member 43 is another finger 77 adapter to abutt an adjustable stop in the form of screw 78 when clamping member 43 is moved in the opposite direction for the other lancet cut. Stop 78 is adjustable to predetermine the degree of rotation of the cannulae in the carrier. An adjustable stop in the other direction is provided by a screw 79 in arm 50*a*, adopted to be engaged by member 43.

The arrangement of the stops 78 and 79 predetermines the rotational movement of the cannulae in either direction in a carrier 15, and the stops may be set in accordance with the diameter of the cannulae.

As shown in FIG. 3, the member defining cam track 36 is laterally movable by virtue of a cylinder (not shown) but indicated by the arrow C acting on member 80. Member 80 is biased from member 34 by springs 81, and is connected to member 35 by slide bearings 82 carried in member 34. When force is applied to member 80 as exemplified, force is transmitted to member 35 to move cam track 36 and actuate follower 58 to release clamping pressure on the cannulae.

At this time, cam track 64 is either shaped, or moved to actuate arms 40 and 41 and produce motion of clamping member 43 in one of the directions of arrow B, FIG. 3. Cam track 36 will then be actuated to move follower 58 and clamping member 43 back to a full clamping position, prior to the carrier reaching station 19. Then at station 19 the first lancet cut is made as exemplified in FIG. 8. After station 19, cam track 36 is shaped or moved so that follower 58 releases pressure on clamping member 43. Then cam track 64 is shaped or moved to move clamping member 43 in a direction opposite to previous movement and rotate the cannulae in the opposite direction to present the cannula for the second lancet cut as exemplified in FIG. 9. Cam track 36 then acts on follower 58 to actuate clamping member 43 prior to station 20. The second lancet cut is then made at station 20.

As the carriers 15 move past cam track 36, spring 59 will move follower 58 to the right as shown in FIG. 5 until roller 63 moves down on cam surface 62, and the cannulae may be easily removed from a carrier 15.

With this arrangement the cannulae are tightly clamped in the carrier for all cutting operations but may be quickly released, rotated, and again tightly clamped for the lancet cuts.

Figure 11:
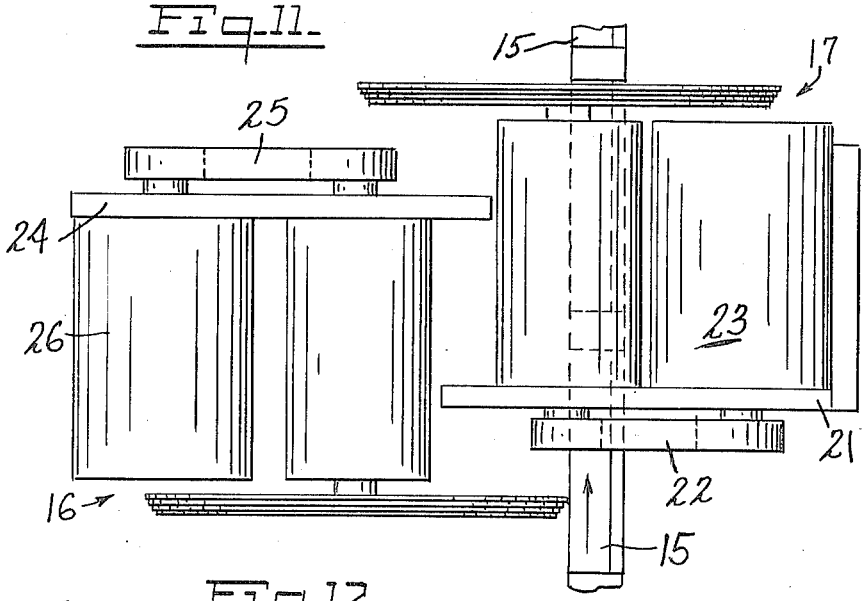
FIG. 11 is an enlarged plan view of a portion of the system of FIGS. 1 and 2.
Figure 12:
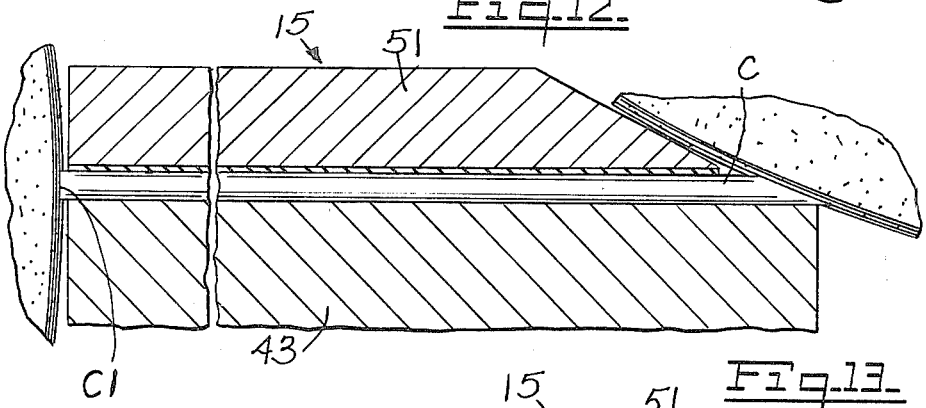
FIG. 12 is an enlarged view, partially in section, of a cannula, and carrier therefore, having the butt end cut and point beveled.

FIG. 11 is a top plan view of stations 16 and 17 and exemplifies a carrier 15 at station 16 and a carrier 15 passing station 17. At station 16, the axis of the cannulae C are on a radius of the center of grinding wheels 16*a*–16*d*. Since the diameter of the wheels is so much greater than the diameter of the cannulae, as shown in FIG. 12, the butt ends C1 are cut essentially perpendicular. The plurality of grinding wheels each take an incremental cut of the tubing extending from carriers 15 and thus increase the spread of operation and hence the number of cannulae which may be prepared in a given period of time. At station 17, the primary bevel is cut in increments, as exemplified in FIG. 12. Each of wheels 17*a*–17*d* quickly removes an increment of primary bevel until the primary bevel C2 is finished. While, the butt end is shown as being ground first, it should be understood that the primary bevel may first be ground.

Figure 13:
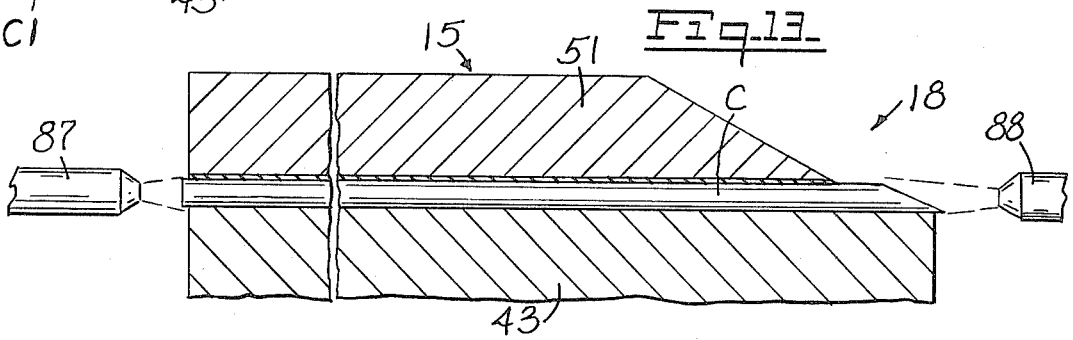
FIG. 13 is a sectional view through a portion of a cannula carrier exemplifying a oxidation removal step after the butt end and primary bevel cut.

FIG. 13 exemplifies station 18, showing a cannula C in a carrier having its cut ends C1 and C2 being bombarded by glass beads or pellets from nozzles 87 and 88 to remove oxidation, resulting from electrolyte grinding, from the cut surfaces thereof, or to remove burrs if wheels 17*a*–17*d* are of the abrasive type.

Figure 14:
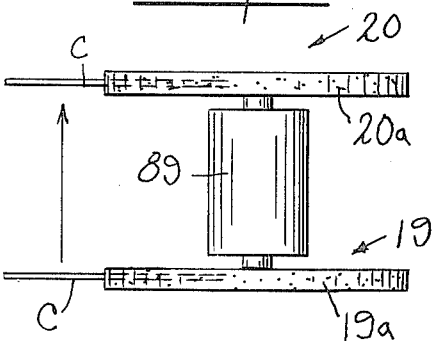
FIG. 14 is a plan view of the grinding wheels of the system of FIG. 1, which make the lancet cuts.
Figure 15:
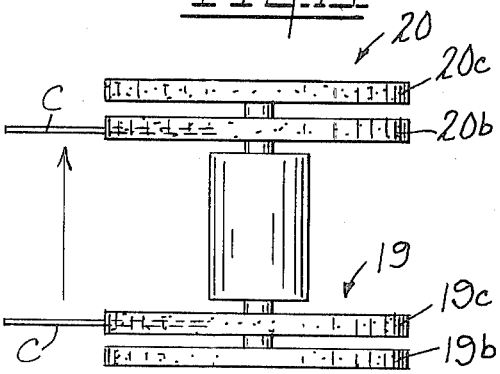

FIG. 14 is a top plan view of stations 19 and 20 showing lancet cutting grinding wheels which are preferably of the abrasive type. Wheels 19*a* and 19*b* may be driven by the same motor 89. Alternatively, each of stations 19 and 20 may comprise a coarse wheel 19*b* and 20*b* and a fine wheel 19*c* and 20*c*.

In operation, a cannulae loaded carrier is placed on conveyor 14. As follower roller 57 of follower 58 rides up incline 36*a* of cam track 36, clamping member 43 is moved up to tightly clamp the cannula in the carrier. At this time, roller 75 is following a surface 76 on guide member 31 and rod 74 is in a cannula center position as shown in FIG. 3. This condition is maintained through stations 16–18. Prior to station 19, cam surface 36 is retracted to permit follower 58 to release pressure on clamping member 43. Then cam track 64 moves follower 38 and arm 40 laterally of the direction of travel of the conveyor and shifts clamping member longitudinally, to slightly rotate the cannulae in the carrier for the first lancet cut at station 19. Then cam track 36 is moved back to clamp the cannulae during the first lancet cut. Thereafter, cam track 36 is again moved back to lessen pressure on the cannula. Cam track 64 pivots arms 40 and 42 in the opposite direction then just prior to station 19, and clamping member moves until finger 77 engages stop 78 to rotate the cannulae in the opposite direction for the second lancet cut at station 20. Cam track 36 is again moved in to cause clamping member 43 to again tightly clamp the cannulae prior to station 20. Thereafter, when follower 58 leaves track 36, follower 58 will extend, springs 54 will bias clamping member 43 downwardly and the cannulae are removed. The carrier 15 is then reloaded with tubing and started again through the system.

Various modifications may be made to the preferred disclosed embodiment of the invention. The stations 16 and 17 may be electrolytic or abrasive grinding stations. If the wheels are abrasive, then the first three wheels as shown will be employed to first rough grind the primary bevel and butt end and then a softer fourth wheel will be employed to finish grind the butt ends and bevels.

Also, if desired, electrolytic wheels can be used to rough grind the bevel and/or the butt end and the finish grind made with a soft abrasive grinding wheel.

At the cleaning station, multiple spray units can be used to expedite the cleaning or ensure better deburring means if abrasive wheels are used, or a better cleaning means if only electrolytic wheels are used.

After the side grinds are completed to provide the lancets, another glass bead station or other media may be used to spray the finished points and radius edges of a part of the lancets and primary cut to provide a sharper needle. In such case, the point would be bombarded below the line L, FIG. 10, to radius, the edges of the bevel, and a portion of the lancets, and thus provide a more easily insertable cannula.

The cleaning station 18 may be eliminated if one wants to use a chemical polish or electrochemical polishing/solution to completely clean the oxidation from the electrolytically ground bevels.

It may thus be seen that the objects of the invention set forth as well as those made apparent from the foregoing description are efficiently attained. While preferred embodiments of the invention have been set forth for purposes of disclosure, modification to the disclosed embodiments of the invention as well as other embodiments thereof may occur to those skilled in the art. Accordingly, the appended claims are intended to cover all embodiments of the invention and modifications to the disclosed embodiments which do not depart from the spirit and scope of the invention.

What I claim is:

1. Apparatus for forming finished cannula from tubing in a continuous operation comprising first, second, and third work stations, at least one carrier for holding the tubing with the ends thereof exposed, a conveyor for carrying said carriers past said stations, guide means for guiding said carriers on said conveyor past said work stations, said first work station comprising a plurality of grinding wheels of progressively increasing diameter to incrementally make one of a butt or primary bevel cut, said second work station comprising a plurality of grinding wheels of progressively increasing diameter to incrementally make the other of said butt or primary bevel cut, said third station comprising grinding wheels, and means for rotating said tubings in said carriers to present tubings to said third station for lancet cuts on either side of the primary bevel.

2. The apparatus of claim 1 further including a further station between said second and third stations for cleaning the cut ends of said tubings.

3. The apparatus of claim 1 further including a fourth station after said third station, said further station adopted to bombard the points of the cannula to radius edges thereof.

4. The apparatus of claim 1 where said carriers include releasable clamping means for tubings therein, and means for releasing said clamping means prior to said third station to rotate said tubings and reclamping said tubings after rotation thereof for the lancet cuts.

5. The apparatus of claim 1 where said carrier comprises a base portion having upstanding arms, a crossmember extending across said arms, a clamping member beneath said crossmember, means for moving said clamping member upwardly to clamp tubings against said crossmember, means for partially releasing clamping pressure and moving said clamping member parallel with respect to said crossmember to rotate said tubings.

6. A carrier member according to claim 5 further including means for predetermining movement of said clamping member with respect to said bridging member.

7. The apparatus of claim 5 where said means for moving said clamping member to clamp the tubing comprises a follower member, a cam track on said guide means, said follower member acting on a cam on said clamping member.

8. The apparatus of claim 5 further including camming means for predetermining movement of said clamping means, prior to said third station, and a follower carried by said clamping member.

9. The apparatus of claim 8 where said follower extends through an opening in said conveyor and said camming member is positioned below said conveyor.

10. The apparatus of claim 1 including a further station between said second and third stations for cleaning the cut ends of said tubings.

11. The apparatus of claim 1 further including a fourth station after said third station, said fourth station adopted to bombard the points of the cannula to radius edges thereof.

12. The apparatus of claim 1 where said carriers include releasable clamping means for tubings therein, and means for releasing said clamping means prior to said third station to rotate said tubings and reclamping said tubings after rotation thereof for the lancet cuts.

13. The apparatus of claim 1 where said first and second work stations are electrolytic grinding wheels.

14. The apparatus of claim 1 where said third work station comprises spaced apart grinding wheels, each arranged to make a lancet cut on said tubings.

15. The apparatus of claim 1 where said third station comprises a first pair of grinding wheels arranged to make a course and a fine lancet cut, and a second pair of grinding wheels arranged to make a course and a fine lancet cut.

16. A carrier member for holding tubings to be ground into cannulae with the ends thereof exposed for grinding, comprising a base portion having upstanding arms, a crossmember extending across said arms, a clamping member beneath said crossmember, means for moving said clamping member upwardly to clamp tubings against said crossmember, and means for partially releasing clamping pressure and moving said clamping member with respect to said crossmember to rotate said tubings.

17. A cartridge according to claim 16 further including means for predetermining movement of said clamping member with respect to said bridging member.

18. A method of making cannulas comprising the steps of providing a carrier for holding cannula tubing therein with the ends thereof exposed, moving said carrier past a first station to cut one of the butt end or primary bevel on one end of the tubing, moving said carrier past a second station to cut the other of the butt or primary bevel on the other end of said tubes, rotating said tubes in said carrier as said carrier is moved to a third station to cut a lancet on one side of the primary bevel, and rotating said tubes in said carrier to present the other side of the primary bevel to a fourth station which makes a lancet cut on the other side of the primary bevel.

19. The method of claim 18 where said butt end and said primary bevel cuts are made in increments by a plurality of grinding wheels of progressively increasing diameter.

20. The method claim 18 where said grinding wheels are of the electrolytic type.

21. The method of claim 20 where oxidation on the ends of said tubes resulting from said electrolytic grinding is cleaned off at another station by bombarding the ends of said tubes with beads.

22. The method of claim 21 where said another station is immediately subsequent to said second station.

23. The method of claim 18 where said carrier is moved continuously past said stations.

24. The method of claim 18 including the further step of bombarding the end of the finish ground cannulae with beads to radius edges of the point.

25. A method of making cannulae comprising the steps of providing a carrier for holding cannula tubing therein with the ends thereof exposed, moving said carrier past a first station to cut one end of the tubing, moving said carrier past a second station to cut the other end of said tubes, one of said cuts being a bevel cut, rotating said tubes in said carrier as said carrier is moved to a third station to cut a lancet on one side of the primary bevel, and rotating said tubes in said carrier to present the other side of the primary bevel to a fourth station which makes a lancet cut on the other side of the primary bevel.

26. Apparatus for forming finished cannulae from tubing in a continuous operation comprising first, second, and third work stations, at least one carrier for holding the tubing with the ends thereof exposed, a conveyor for carrying said carriers past said stations, guide means for guiding said carriers on said conveyor past said work stations, said first work station comprising a plurality of grinding wheels of progressively increasing diameter to incrementally cut one end of said tubing, said second work station comprising a plurality of grinding wheels of progressively increasing diameter to incrementally cut the other end of said tubing, one of said first and second stations making a bevel cut, said third station comprising grinding wheels, and means for rotating said tubings in said carriers to present tubings to said third station for lancet cuts on either side of the primary bevel.

* * * * *